United States Patent [19]

Lockwood

[11] 4,222,169

[45] Sep. 16, 1980

[54] CUTTER FOR CUTTING OUT PROFILES FROM SHEET MATERIAL

[76] Inventor: Christopher R. Lockwood, Hunters Oak, Asheridge, Chesham, Buckinghamshire, England

[21] Appl. No.: 956,785

[22] Filed: Nov. 1, 1978

Related U.S. Application Data

[63] Continuation-in-part of Ser. No. 822,882, Aug. 8, 1977, abandoned.

[30] Foreign Application Priority Data

Aug. 10, 1976 [GB] United Kingdom ..... 33252/76

[51] Int. Cl.[3] ..... B26B 29/00

[52] U.S. Cl. ..... 30/286; 30/310; 33/27 K; 83/565

[58] Field of Search ..... 30/300, 310, 286; 33/27 K, 30 B; 83/565

[56] References Cited

U.S. PATENT DOCUMENTS

| | | | |
|---|---|---|---|
| 705,576 | 7/1902 | Forker | 83/565 |
| 742,047 | 10/1903 | Moehle | 33/27 K |
| 815,564 | 3/1906 | Stickney | 83/565 |
| 1,527,763 | 2/1925 | Vance | 33/27 K |
| 2,122,261 | 6/1938 | Morris | 83/565 X |

*Primary Examiner*—Harold D. Whitehead

*Attorney, Agent, or Firm*—Omri M. Behr; Martin Sachs

[57] ABSTRACT

A cutter for cutting out profiles from sheet material, the cutter having a cutter blade mounted on a pivoted arm whose movement round a fulcrum causes variation in the effective length of the arm by means of a cam and cam follower combination.

4 Claims, 5 Drawing Figures

CUTTER FOR CUTTING OUT PROFILES FROM SHEET MATERIAL

The present application is a continuation-in-part of application Ser. No. 822,882, filed Aug. 8, 1977, and now abandoned.

BACKGROUND OF THE INVENTION

This invention relates to a cutter for cutting out profiles from sheet material that is capable of being cut by hand.

It is an object of the present invention to provide such a cutter that is simple, inexpensive and easy to operate.

A cutter for cutting out profiles from sheet material according to the principles of the present invention comprises a cutter blade mounted on an arm, a fulcrum about which the arm is rotatable, a cam fixed relative to the fulcrum and proximate thereto, and a cam follower mounted on the arm and engaging the cam to control the distance between the fulcrum and the cutter blade upon rotation of the arm about the fulcrum.

Preferably the cutter blade is adjustable along the length of the arm.

The cam may have formed therein a channel and the cam follower may comprise a pin adapted to engage the channel.

BRIEF DESCRIPTION OF THE DRAWINGS

An embodiment of the present invention will now be described, by way of example, with reference to the accompanying drawings, in which.

DESCRIPTION OF THE PREFERRED EMBODIMENT

Figure 1:
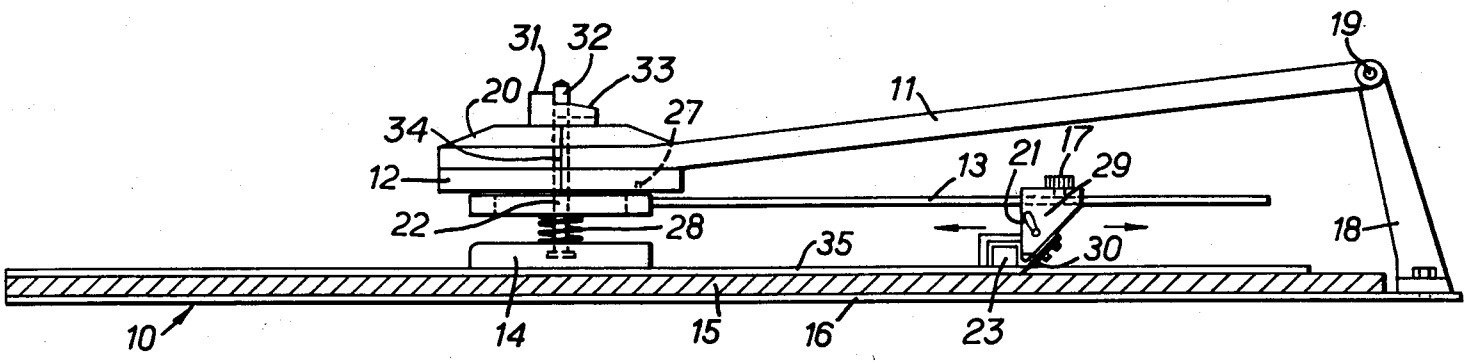
FIG. 1 is a side elevational view of a cutter according to the present invention.

The cutter illustrated in the drawing is particularly intended for producing circular or elliptical shapes within a mounting board for photographs or works of art, the mounting board being located on a base surface 10 and the cutter comprising a cantilevered arm 11 which carries a cam 12, a cutter operating arm 13 and a lower pressure pad 14.

The base surface 10 is provided by a resilient pad 15, in this embodiment made of rubber, which is mounted on a rigid backing layer 16. The layer 16 extends beyond one edge of the pad 15 and a hinge block 18 is secured to the layer 16, the hinge block 18 having a hinge 19 to which is attached one end of the arm 11.

The other end of the arm 11 is provided on its upper surface, as seen in FIG. 1, with an upper pressure pad 20 and has secured to its lower surface the cam 12. A spindle 22 is secured to the lower pressure pad and passes through the center of the arm 13 and the cam 12 to engage the pressure pad 20. On the top surface of the pad 20 is a boss 31 through which the spindle 22 passes. A radially projecting pin 32 on the spindle engages a cam surface 33 in the wall of the base. The cam surface 33 extends from an upper horizontal dwell area downwardly to a lower horizontal dwell area. A slot 34 communicates with the spindle hole in the pad 20. The boss 33 is adapted to receive the pin 32 upon disassembly.

Figure 2:
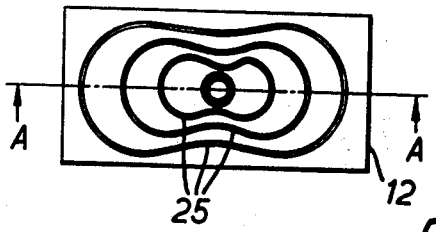
FIG. 2 is a bottom plan view of a cam used in the cutter of FIG. 1.
Figure 3:
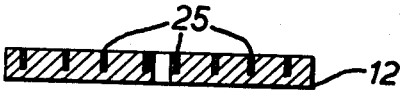
FIG. 3 is a sectional view taken along the line A—A of FIG. 2.

The bottom face of the cam 12, as seen in FIGS. 2 and 3, is provided with a number of concentric grooves or channels 25. In this embodiment four channels 25 are provided, the innermost being for use in cutting out a circular shape, and the outer three being for use in cutting out elliptical shapes.

Figure 4:
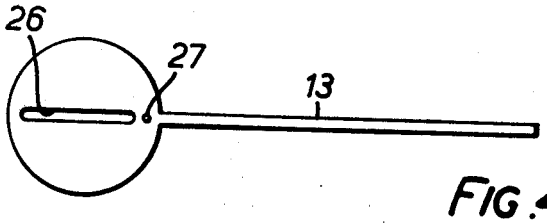
FIGS. 4 and 5 are respectively plan and side elevational views, to a smaller scale than FIG. 1, of a cam follower and arm used in the cutter of FIG. 1.
Figure 5:
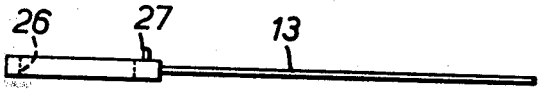

The cutter operating arm 13 has at one end thereof a slot 26 (FIGS. 4 and 5) which is engaged by the spindle 22, and an upwardly projecting cam follower in the form of a pin 27 which engages, selectively, one of the channels 25. The pin 27 is biased into engagement with the channel 25 by a spring 28 mounted between the lower pressure pad 14 and the end of the arm 13. Also mounted on the arm 13 is a cutter mounting block 29. The arm 13 passes through a passage in the block 29 and is engageable by a locking screw 17 so that the block 29 is adjustable along the length of the arm, to vary its distance from the spindle 22. A cutter blade 30 is mounted on block 29 and is inclined at 45° as shown to provide a pleasing bevelled frame effect. The mounting of the cutter blade on the block is accomplished by means of a slide, and a rack integral with the slide cooperates with a pinion secured to an external lever 21 so that the height of the blade and therefore the depth of cut can be adjusted. A roller 23 supports the mounting block on the surface of the material to be cut.

In operation, the pin 27 is first engaged in the appropriate cam channel 25 by twisting the block 14 so that the pin 32 rides down the cam surface 33 and, if necessary, moving the arm 13, and therefore the pin 27, away from the cam 12 against the bias of the spring 28. Arm 13 is moved on the spindle 22 until the pin 27 is in register with the desired channel 25 and then released permitting the arm 13 to engage the pin 27 in the channel 25. Twisting the block 14 in the opposite direction causes the pin 32 to ride up and locate on the upper dwell portion of the cam surface 33 to lock the pads 14 and 20 together as a unit. The position of the cutter mounting block 29 is then adjusted as desired along the arm 13. The sheet material 35 to be cut is then placed flat on the base surface 12, the arm 13 is pivoted about the hinge 19 to be well clear of the base surface 10.

The arm 11 is then lowered until the lower pressure pad 14 engages the surface of the material 35 and takes the weight of the mechanism. Pressure now applied by hand to the pressure pad 20 fixes the position of the pad 14 and the spindle 22. Additional pressure on the block 29 causes the cutter blade 30 to penetrate the material 35 until the roller 23 rests on the surface of the material 35. The roller 23 may be provided with a means for providing an adjustable height to limit the depth of penetration of the blade 30 into the material 35, in a conventional manner, not shown. The pressure applied by hand to the pressure pad 20 while the cutter operating arm 13 is rotated about the fulcrum formed by the spindle 22 engaging the side of the slot 26 exerts a clamping pressure on the material 35 maintaining it in position.

The cutter operating arm 13 when rotated with the pin 27 being engaged in the channel 25 causes the arm 13 to move longitudinally relative to the fulcrum or spindle 22 to vary the distance of the cutter blade 30 from the fulcrum in the case of an ellipse or maintain it constant in the case of a circle. Generally the cam and cam follower act to control the distance between the blade 30 and the fulcrum.

It should be noted that the difference in radius between various positions of one cam profile are reproduced at a ratio of 1:1 at the cutter. Thus, many variations of the elliptical shape are obtainable by setting the cutter block at different radii and utilizing different cam profiles.

The pressure pad 14 may incorporate a centrally disposed pin, not shown, which penetrates the layer 16 when the cutter is used for making frames or other items where the damage to the central cutout is of no consequence.

The preferred embodiment described may be modified by providing different cam profiles suitable for cutting other generally curved shapes. In particular, for cutting elliptical shapes two pins may be provided on the cutter arm 13 to engage respective ones of perpendicular slots in the cam. The general consideration is, however, that as the arm 13 is rotated about the spindle the distance of the cutter blade from the spindle is controlled by engagement between engaging elements on the arm and the cam.

Hereinbefore has been disclosed a simplified cutter for cutting out profiles from sheet material which provides a means for holding the material in position while cutting it. It will be understood that various changes in the details, materials, arrangements of parts and operating conditions which have been herein described and illustrated in order to explain the nature of the invention may be made by those skilled in the art within the principles and scope of the invention.

I claim:

1. A cutting apparatus for cutting out profiles from sheet material, comprising in combination:

(a) arm means having an elongated slot at one end thereof and being provided with a follower pin proximate said slot;

(b) cutting means mounted on the other end of said arm means;

(c) lower pressure pad means having a lower surface adapted to come into pressure contact with said material, said lower pressure pad means being provided with a centrally disposed fulcrum extending upwardly therefrom and adapted to receive the slot of said arm;

(d) upper pressure pad means having a centrally disposed aperture therein adapted to receive and retain the upper portion of said fulcrum therein, said upper pressure pad means being provided with an outwardly extending arm having hinge means provided on its distal end;

(e) hinge block means operatively connected to said upper pressure pad means hinge means on one end and adapted to be affixed to a surface for receiving said material to be cut;

(f) cam means affixed to the lower surface of said upper pressure pad means, said cam means being provided with a plurality of grooves therein adapted to slidably receive said arm means follower pin; and (g) spring means circumscribing said fulcrum and disposed between said pressure pad means and said one end of said arm means for retaining said follower pin in one of said plurality of grooves; whereby exerting pressure on said upper pressure pad causing said lower pressure pad to contact said material and rotating said arm means with said cutting means piercing material causes said material to be cut in a shape proportioned to said selected groove.

2. A cutting apparatus according to claim 1 wherein said cutting means is slidably mounted on said arm means and the distance from the cutting means to the fulcrum is adjustable.

3. A cutting apparatus according to claim 2 wherein said cutting means includes means for adjusting the depth of penetration into said material.

4. A cutting apparatus according to claim 3 wherein said means for adjusting the depth of penetration into said material includes a roller means disposed proximate said cutting means, said roller means having an adjustable height.

* * * * *